United States Patent [19]

Gorza

[11] Patent Number: 5,065,532

[45] Date of Patent: Nov. 19, 1991

[54] CLOSURE DEVICE, PARTICULARLY FOR SKI BOOTS, ALLOWING GREATER WORKING LENGTH OF THE TIGHTENING CABLES

[75] Inventor: Roberto Gorza, Feltre, Italy

[73] Assignee: Nordica S.p.A., Montebelluna, Italy

[21] Appl. No.: 555,877

[22] Filed: Jul. 23, 1990

[30] Foreign Application Priority Data

Jul. 31, 1989 [IT] Italy ..... 59392/89[U]
Jul. 31, 1989 [IT] Italy ..... 59393/89[U]

[51] Int. Cl.[5] ..... A43B 5/04
[52] U.S. Cl. ..... 36/117; 36/50; 24/68 SK
[58] Field of Search ..... 36/117, 118, 119, 120, 36/121, 50; 24/68 SK, 68 B

[56] References Cited

U.S. PATENT DOCUMENTS

| | | | |
|---|---|---|---|
| 4,596,080 | 6/1986 | Benoit et al. | 36/120 |
| 4,669,201 | 6/1987 | Pozzobon | 36/117 |
| 4,741,115 | 5/1988 | Pozzobon | 36/117 |
| 4,937,951 | 7/1990 | Loecker | 36/119 |
| 4,937,952 | 7/1990 | Olivieri | 36/119 |
| 5,003,711 | 4/1991 | Nerrinck et al. | 36/120 |

FOREIGN PATENT DOCUMENTS

| | | | |
|---|---|---|---|
| 3532455 | 4/1986 | Fed. Rep. of Germany | 36/117 |

*Primary Examiner*—Paul T. Sewell
*Assistant Examiner*—Thomas P. Hilliard
*Attorney, Agent, or Firm*—Guido Modiano; Albert Josif

[57] ABSTRACT

The closure device includes a lever pivoted at a pivoting axis to the rear quarter of a ski boot; each of two cables has a first end connected to the front quarter, is guided at a slider on the lever and has a second end connected to the rear quarter. The slider position is adjustable and the lever can take up twice the length of cable with respect to traditional levers.

7 Claims, 3 Drawing Sheets

CLOSURE DEVICE, PARTICULARLY FOR SKI BOOTS, ALLOWING GREATER WORKING LENGTH OF THE TIGHTENING CABLES

BACKGROUND OF THE INVENTION

The present invention relates to a closure device particularly usable in ski boots comprising a front quarter and a rear quarter associated with a shell, and having a pivoting lever.

Several devices are currently known for closing the quarters, generally constituted by a cable the ends whereof are associated with the sides of the front quarter; the cable is then connected to an adapted vertical lever associated with the rear quarter.

Such known devices have some disadvantages, among which a main one is that the working length of the cable is usually insufficient to also allow the complete opening of the quarters when the lever is opened, and it is therefore difficult to insert the foot in the boot.

As a partial solution to these disadvantages, a French Patent Application, no. 82 19676, dated Nov. 24, 1982, discloses a quarter closure device which comprises a strap embracing the front quarter, and an array of holes, arranged along two parallel axes on said strap.

Two cables are associated within said holes, partially wind on a longtudinal projection at the rear quarter and engage with a vertical lever.

A variated embodiment is also illustrated in which two pulleys are provided instead of said projection and the lower pulley is adjustable.

This known device, however, also has disadvantages: it is structurally complicated and bulky, because of the fixed projecting guide which occupies most of the rear quarter, and also the lay-out of the cables is excessively complicated.

A French Patent Application no. 8508207 published as No. 2582486 filed on May 31, 1985, discloses a device for tensioning a flexible element for connecting two elements and is particularly applicable for closing the quarters of a ski boot. The flexible connecting element passes into a first movable guide element which is supported by a pivoting lever, for the tensioning thereof, so as to make a first loop, then passes around a second fixed guide element and forms a second loop; the flexible connecting element and the two guide elements constitute the equivalent of a pulley.

This device has the disadvantage that most of the possible embodiments can be provided only by using straps, because the loops radius is very small.

Furthermore, the pivoting axis of the lever must be at a considerable distance from the boot surface, to keep the lever in the closed position.

It is therefore difficult to insert the lever in the boot from a styling point of view, and this lever is in any case bulky.

The use of a strap as flexible connecting element furthermore entails, in the described solutions, the tensioning of said strap during the first lever opening step: this, too, is a disadvantage, since the quarters are tightened further on the leg.

The device therefore has a structure which is not easy to operate.

U.S. Pat. No. 4,691,454 discloses a closure system for ski boots wherein a lever system is adapted to operate two cables. This lever system can take up a longer portion of cable than with respect to the traditional lever systems but this is accomplished with a very complicated and heavy structure.

Finally, it is known that in the known levers for closing the quarters in a ski boot, a rotation of approximately 180 degrees of said lever is followed by the take-up of a length of cable, which is equal to twice the distance between the pivoting axis of the lever and the connection point of the cable on said lever.

It is furthermore known that during the first part of the rotation imparted to these known levers there is no tensioning of the cables, and no work is produced in this step.

SUMMARY OF THE INVENTION

The aim of the present invention is therefore to eliminate the disadvantages described above in known types by providing a device for optimally closing and tightening the quarters of a rear-entry ski boot and which is at the same time adapted to sufficiently open the quarters to allow the skier to easily insert the foot in the boot.

Within the scope of the above described aim, an important object is to provide a device adapted to close or open the quarters by means of a single and rapid operation on the part of the skier.

Another important object is to provide a device which is structurally simple as well as reliable and safe in use.

Another object is to provide a device adapted to take up a longer section of the traction elements with respect to the known levers.

Not least object is to provide a device which, together with the above described improved mechanical characteristics, allows for an improved styling of the boot.

The above mentioned aim and objects, as well as others which will become apparent hereinafter, are achieved by a closure device, particularly for ski boots having a front quarter and a rear quarter associated with a shell and comprising a lever pivoted to said rear quarter, characterized in that it comprises at least on traction element, a first end of said traction element being associated with a part which is in relative motion with respect to the pivoting axis of said lever and a second end of said traction element being associated with a part which is fixed with respect to said pivoting axis, said at least one traction element engaging at least one guide member which can be rigidly associated with said lever.

BRIEF DESCRIPTION OF THE DRAWINGS

Further characteristics and advantages of the invention will become apparent from the detailed description of some preferred embodiments, illustrated only by way of nonlimitative example in the accompanying drawings, wherein.

DESCRIPTION OF THE PREFERRED EMBODIMENTS

Figure 1:
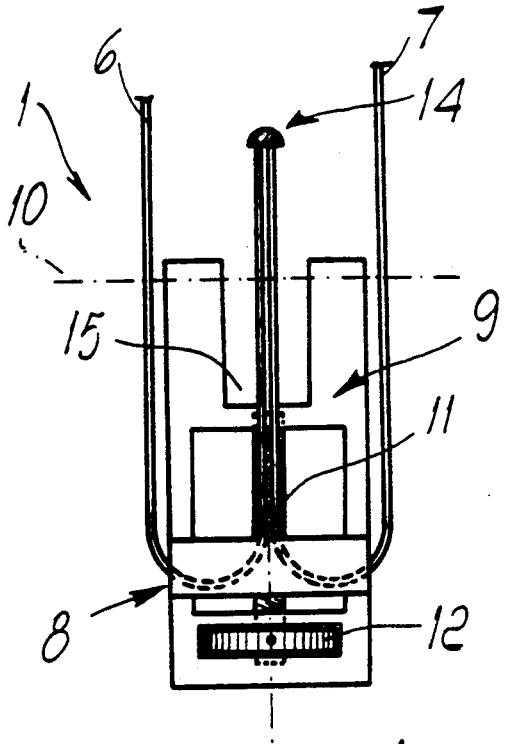
FIG. 1 is a rear view of the device.
Figure 2:
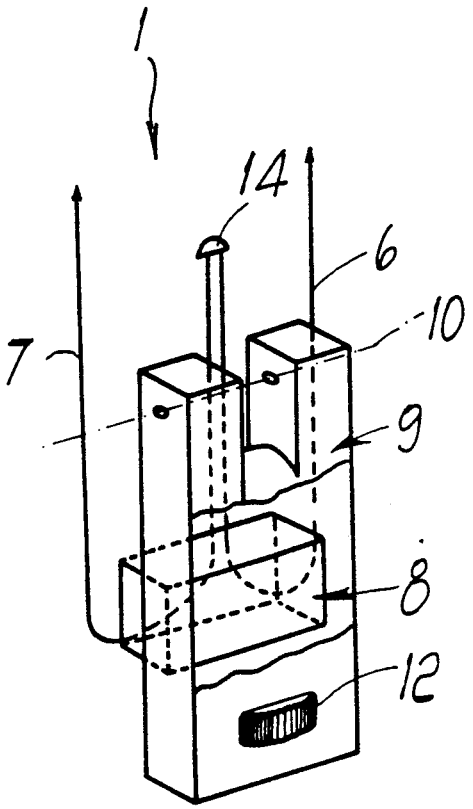
FIG. 2 is a schematic isometric view of the device.
Figure 3:
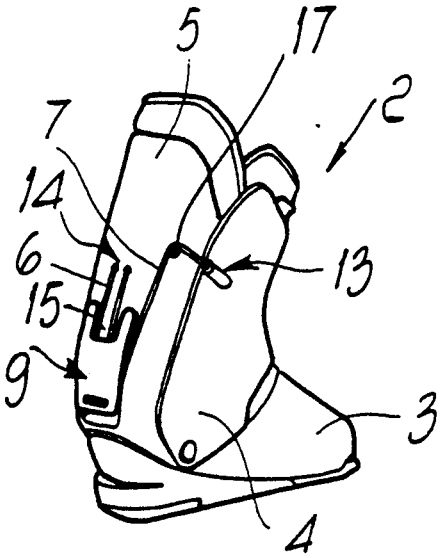
FIG. 3 is an isometric view of a ski boot having the device according to the invention.
Figure 4:
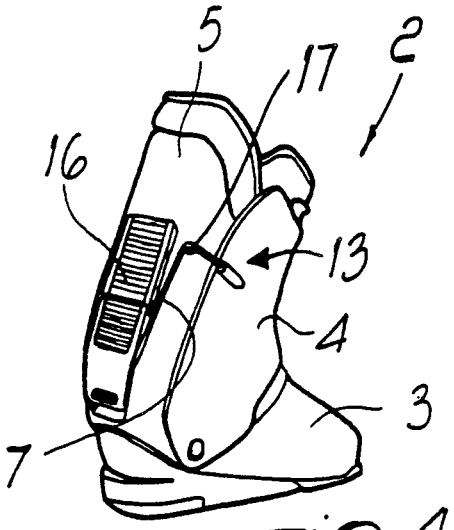
FIG. 4 is a view, similar to the preceding one, showing the use of a covering element on the device.

With reference to the above figures, the reference numeral 1 indicates a closure device applied to a ski boot 3 comprising a front quarter 4 and a rear quarter 5 articulated to a shell 2, in a per se known manner.

Said device comprises a first cable 6 and a second cable 7 guided at a guide member constituted by a slider 8 which is movable along a vertical lever 9. The vertical lever 9 is pivoted at the back of the rear quarter 4 at a pivoting horizontal axis 10.

Said slider 8 is moved along the lever, for example, by means of a screw 11 pivoted, at the free end, approximately at the longitudinal middle axis of the vertical lever 9; a knob 12 is associated with said screw at one end and can be actuated by the user, whereas the stem of said knob interacts at a complementarily threaded seat provided on said slider which is arranged transversely to said vertical lever.

Said first and second cables have their first end, indicated by 13, associated with a moving part which is in relative motion with respect to the pivoting axis 10 of the vertical lever 9 during closure; said moving part is advantageously constituted by the outer lateral surface of the front quarter 4. The cables are therefore arranged at the sides of the front and rear quarters, and guided at guide elements provided on the rear quarter (only guide element 17 is shown in the figures).

The first and second cables are then arranged at the sides of the vertical lever 9 and are guided at the slider 8 in seat means provided therein in a per se known manner to subsequently arrange themselves approximately parallel to one another at the longitudinal middle axis of said lever. The second end 14 of each cable is associated at a fixed portion with respect to the pivoting axis 10 of said lever 9, during rotation of the lever; said fixed portion is, for example, constituted by the rear quarter 5.

According to this embodiment, the amount of the cables released upon the opening of the vertical lever 9 is constituted by the sum of twice the distance between the pivoting axis 10 of the vertical lever 9 and the exit point of the first and second cables laterally to said lever, plus twice the depth of the depression 15, provided on the vertical lever 9 between the end pivoted at the axis 10 and approximately the point of maximum excursion of the slider 8 toward said axis.

It is thus possible to raise the exit point of the cables from the lever and consequently lower the transmission points on the rear quarter while preserving the extent of the opening of the quarters.

Considerable advantages are thus achieved, such as a reduction of the vertical bulk at the guide/lever assembly on the rear quarter.

The lifting of the exit points of the cables from the lever arm furthermore allows to reduce the longitudinal dimension of said lever arm while preserving the value of the closure effort or, alternatively, to reduce the closure effort and preserve the longitudinal dimension of the lever arm.

Finally, the work of the lever is utilized in all the steps in which a rotation is imparted thereto.

The device may advantageously have, at the depression 15, a covering element 16 such as a resilient band.

Figure 8:
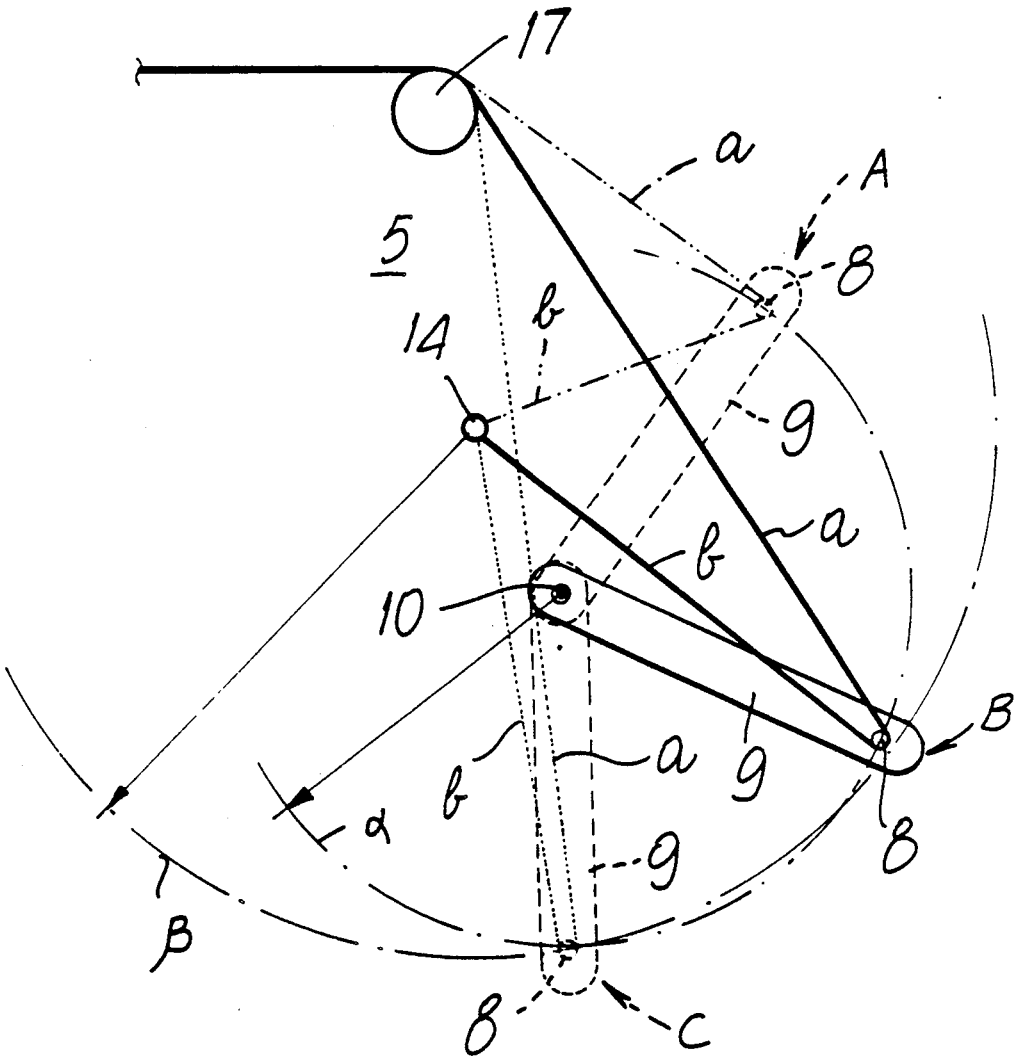
FIG. 8 is a schematic view of the layer of FIGS. 1-2, showing the operation thereof.

It has thus been observed how the device, according to the invention, achieves the intended aim and objects; in particular FIG. 8 shows schematically how the lever 9 works.

During the first part of its rotation (between positions A and B), the lever 9 takes up a double length of cable because both the cable segments a and b variate.

In the second part of the rotation (between positions B and C) of the lever 9, the cable segment b is approximately constant, because the circumference $\alpha$ (defined by the point 8 with center in 10) is substantially coincident with the circumference $\beta$ (having radius b when the lever 9 is in position C).

Therefore, the segment b does not substantially variate its length between positions B and C, while only the segment a variates its length: in this manner, in the last part of the rotation, when the quarters are closed on the leg and there would be an increase of effort necessary to complete the closure, there is in fact a reduction of take-up of the cable and hence no further increase of required effort.

Therefore, the lever according to the invention can take up a double length of cable in the first part of its rotation, with respect to traditional levers, but does not require an extra effort for locking the quarters in the last part of its rotation.

The device may naturally be also constituted by a single traction element which is transmitted on the rear quarter 5 at an adapted transmission located in the region of coupling of the second end 14 of the embodiment which has the first and second cables.

Figure 5:
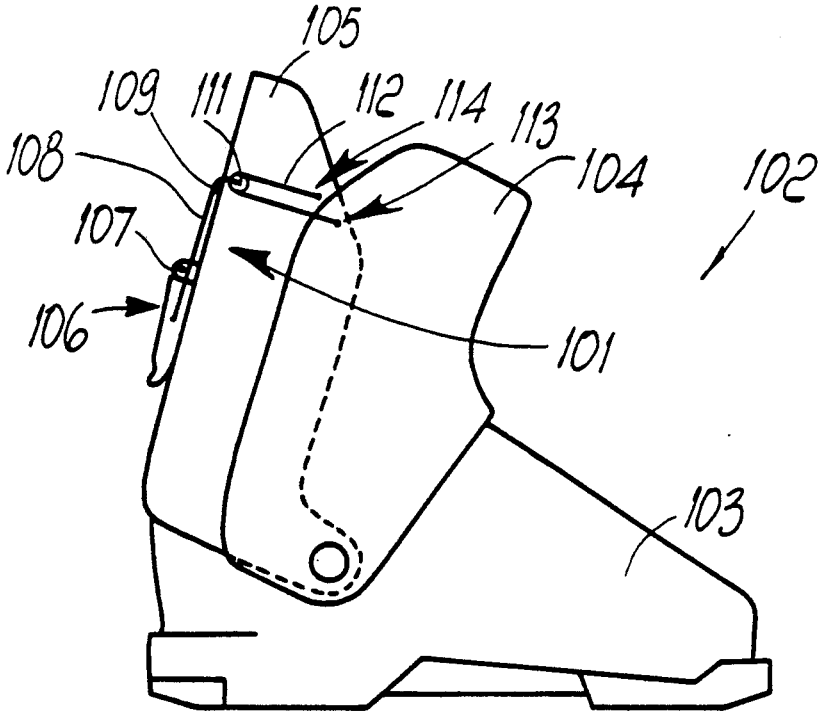
FIG. 5 is a side view of a ski boot, having a device according to a further aspect of the invention, and with the quarters closed.
Figure 6:
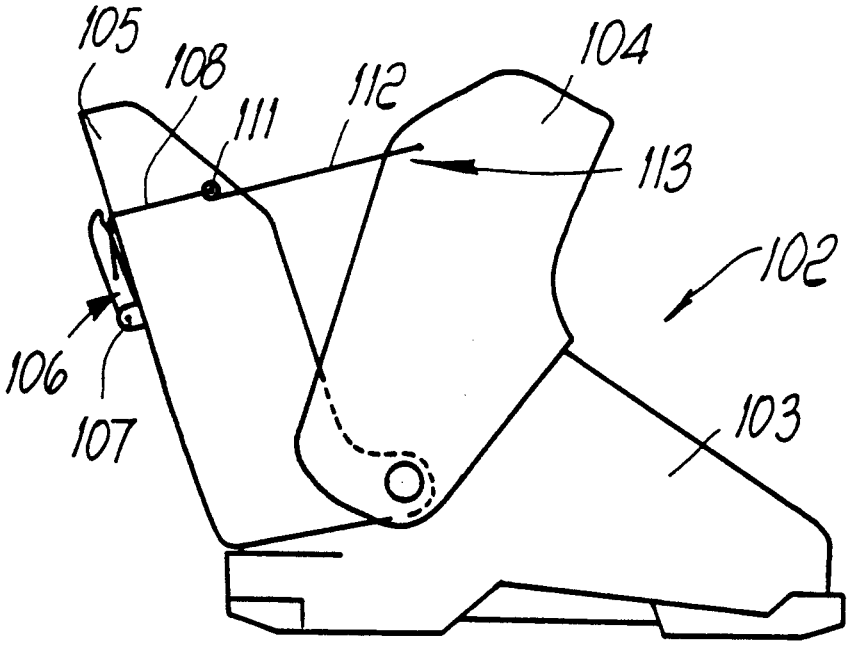
FIG. 6 is a view similar to the preceding one but showing the quarters open.
Figure 7:
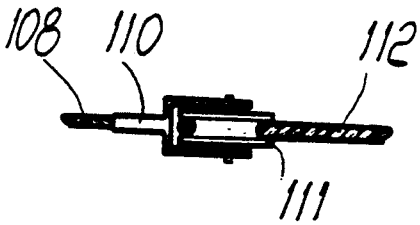
FIG. 7 is a detailed top view of a pulley of the device of FIGS. 5 and 6.

With reference to FIGS. 5-7, the reference numeral 101 indicates a closure device, according to the invention, in a ski boot 102 which is constituted by a front quarter 104 and a rear quarter 105 associated with a shell 103.

The device 101 comprises a vertical lever 106 pivoted to the rear quarter 105 at adapted wings 107 which protrude therefrom.

The device is furthermore constituted by a first traction element, such as a first cable 108, which can be tensioned by means of the lever 106.

Said first cable 108 affects a first pair of guides 109 associated with the rear quarter 105.

The terminal ends of the first cable 108, arranged laterally to the rear quarter 105, are subsequently associated, by means of the interposition of an adapted Y-shaped support 110, with a guide member constituted by a pulley 111 which is freely pivoted to the support 110.

The device furthermore comprises at least one second traction element, such as a second cable 112, which is coupled, at its ends, to a first point 113 and to a second point 114 which are mutually adjacent when the quarters are closed and are arranged respectively on said front quarter 104 and on said rear quarter 105.

This embodiment allows, when opening or closing the lever 106, to release or tension the second cable 112 by a length which is four times the distance between the axis for pivoting to the wings 107 of the lever 106 and the exit point of the first cable 108 laterally to said lever 106.

Considerable advantages are furthermore achieved, such as a reduction of the vertical bulk at the guide/-lever assembly on the rear quarter.

Finally, the lever works during its entire rotation.

It has thus been observed that the invention has achieved the intended aim and objects, the device allowing a greater take-up of the traction elements than that achieved by the known art, active work being furthermore, imposed to the lever during its entire rotation.

The materials and the dimensions which constitute the individual components may naturally be the most pertinent according to the specific requirements.

I claim:

1. Closure device, particularly for ski boots having a front quarter and a rear quarter connected with a shell, said device comprising:

a lever means being pivoted to the ski boot rear quarter about a pivoting axis thereof, a guide member means being connected to said lever means, at least one traction element means defining a first end, a second end, and a middle portion thereof, said first end of said traction element means being connected to a portion of said front quarter, said middle portion of said traction element means guidingly engaging with said guide member means, and said second end of said traction element means being connected to a part of the ski boot which is fixed relative to said pivoting axis, wherein said at least one traction element means comprises at least one cable and said guide member means comprises a slider, said slider being provided with a threaded through seat, said device further comprising a screw rotatably connected to said lever means along a longitudinal middle axis thereof and knob means connected to said screw to thereby allow for user-actuated rotation of said screw relative to said lever means, said threaded seat of said slider being threadingly mounted on said screw thereby allowing translatory motion of said slider relative to said lever means along said lever means longitudinal axis, said first end of said at least one cable being connected to an outer lateral surface of said front quarter, said middle portion of said at least one cable slidingly engaging in a guiding element means provided on said rear quarter and then slidingly engaging in seat means provided in said slider, said middle portion of said at least one cable further extending upwards from said slider parallel to said longitudinal axis to where said second end of said at least one cable is connected to a part of said rear quarter defined thereon at a position above said pivoting axis, and wherein said at least one traction element means comprises a first said cable and a second said cable, said first cable and said second cable being mutually symmetrically arranged on the ski boot with respect to said longitudinal axis of said lever means, said lever means defining a first section along which said slider can move and a second section having a depression, said depression being covered by a covering element.

2. Device according to claim 1, wherein said part of the ski boot which is fixed relative to said pivoting axis and to which is connected said second end of said traction element means is a part of said rear quarter defined thereon at a position above said pivoting axis.

3. Closure device, particularly for ski boots having a front quarter and a rear quarter connected with a shell, said device comprising:

a lever means being pivoted to the ski boot rear quarter about a pivoting axis thereof, a guide member means being connected to said lever means, at least one traction element means defining a first end, a second end, and a middle portion thereof, said first end of said traction element means being connected to a portion of said front quarter, said middle portion of said traction element means guidingly engaging with said guide member means, and said second end of said traction element means being connected to a part of the ski boot which is fixed relative to said pivoting axis, wherein said guide member means comprises a guide member pulley rotatingly pivoted to a Y-shaped support member, said Y-shaped support member being connected to said lever means by means of a first cable which slidingly engages in guide means connected to the ski boot rear quarter, said at least one traction element means comprises a second cable, said first end of said second cable being connected to a first point on said front quarter, said middle portion of said second cable slidingly engaging around said guide member pulley, said second end of said second cable being connected to a second point of said rear quarter, said first point on said front quarter and said second point on said rear quarter being mutually adjacent when said quarters are closed.

4. Device according to claim 3, wherein said at least one traction element means comprises a pair of said second cables which are mutually symmetrically arranged with respect to a longitudinal middle axis of said lever means.

5. Closure device for a rear-entry ski boot which has a shell and a front quarter and a rear quarter both connected thereto, said rear quarter defining a longitudinal middle axis which is substantially a symmetrical axis of said rear quarter, said device comprising a lever means being pivoted to said rear quarter about a pivoting axis defined thereon, a guide member means being connected to said lever means, and at least one traction element means defining a first end, a second end, and a middle portion thereof, said first end of said traction element means being connected to a fixed point on said front quarter, said middle portion of said traction element means being guidingly engaged in said guide member means, and said second end of said traction element means being connected to a fixed point on said rear quarter which is positioned above said pivoting axis and substantially at said symmetrical axis thereof.

6. Closure device according to claim 5, wherein said at least one traction element means comprises a first traction element and a second traction element, said first and second traction elements being mutually arranged substantially symmetrically with respect to said symmetrical axis of said rear quarter thereby said first ends of said first and second traction elements being connected to opposite symmetrical fixed points of said front quarter and said second ends of said first and second traction elements being connected to fixed points on said rear quarter which are positioned above said pivoting axis and substantially mutually symmetrical about said symmetrical axis.

7. Closure device according to claim 5, wherein said at least one traction element means comprises a first traction element and a second traction element, said first and second traction elements being mutually arranged substantially symmetrically with respect to said symmetrical axis of said rear quarter thereby said first ends of said first and second traction elements being connected to opposite symmetrical fixed points of said front quarter and said second ends of said first and second traction elements being connected to fixed points on said rear quarter which are positioned above said pivoting axis and substantially mutually symmetrical about said symmetrical axis, and wherein said guide member means comprises a slider, said slider being provided with a threaded through seat, said device further comprising a screw rotatably connected to said lever means along a longitudinal middle axis thereof and knob means connected to said screw to thereby allow for user-actuated rotation of said screw relative to said lever means, said threaded seat of said slider being threadingly mounted on said screw thereby allowing a translatory motion of said slider relative to said lever means along said lever means longitudinal axis, said slider being provided with seat means for slidingly engaging said first and second traction elements.

* * * * *